United States Patent [19]

Lobmeyer et al.

[11] 4,335,577

[45] Jun. 22, 1982

[54] HYDRAULIC SYSTEM HAVING VARIABLE DISPLACEMENT PUMPS CONTROLLED BY POWER BEYOND FLOW

[75] Inventors: Raymond J. Lobmeyer, Hudson; James A. Miller, Cedar Falls, both of Iowa

[73] Assignee: Deere & Company, Moline, Ill.

[21] Appl. No.: 161,082

[22] Filed: Jun. 19, 1980

[51] Int. Cl.[3] ..... F15B 13/06; F15B 13/09

[52] U.S. Cl. ..... 60/421; 60/422; 60/430; 60/452

[58] Field of Search ..... 60/421, 422, 430, 452

[56] References Cited

U.S. PATENT DOCUMENTS

| | | | |
|---|---|---|---|
| 2,892,311 | 6/1959 | Gerpen | 60/422 |
| 3,455,210 | 7/1969 | Allen | 60/52 |
| 3,465,519 | 9/1969 | McAlvay et al. | 91/446 |
| 3,718,159 | 2/1973 | Tennis | 137/596.12 |
| 3,760,689 | 9/1973 | Johnston | 60/421 X |
| 3,863,449 | 2/1975 | White, Jr. | 60/464 X |
| 4,044,786 | 8/1977 | Yip | 60/422 X |
| 4,116,001 | 9/1978 | Orth | 60/422 X |
| 4,286,502 | 9/1981 | Bianchetta et al. | 91/445 |

*Primary Examiner*—A. Michael Chambers

[57] ABSTRACT

The displacement controllers of a first variable displacement pump supplying fluid for hoe and travel functions of an excavator and a second pump supplying fluid for the excavator house swing function are connected to shuttle valves which operate to couple to the controllers the lesser of the power beyond fluid pressures emanating from travel function and swing function control valves. A bypass circuit is arranged to couple power beyond flow from the swing function control valve to join the flow being outputed from the first pump when the pressure of the last-named power beyond flow exceeds the lesser of that emanating from the travel control functions. Lead compensators are provided to make the controllers more responsive to circuit demands and a power limiting valve is provided for automatically connecting pressure for destroking the pumps to relieve engine load when the engine speed falls to a predetermined minimum.

5 Claims, 1 Drawing Figure

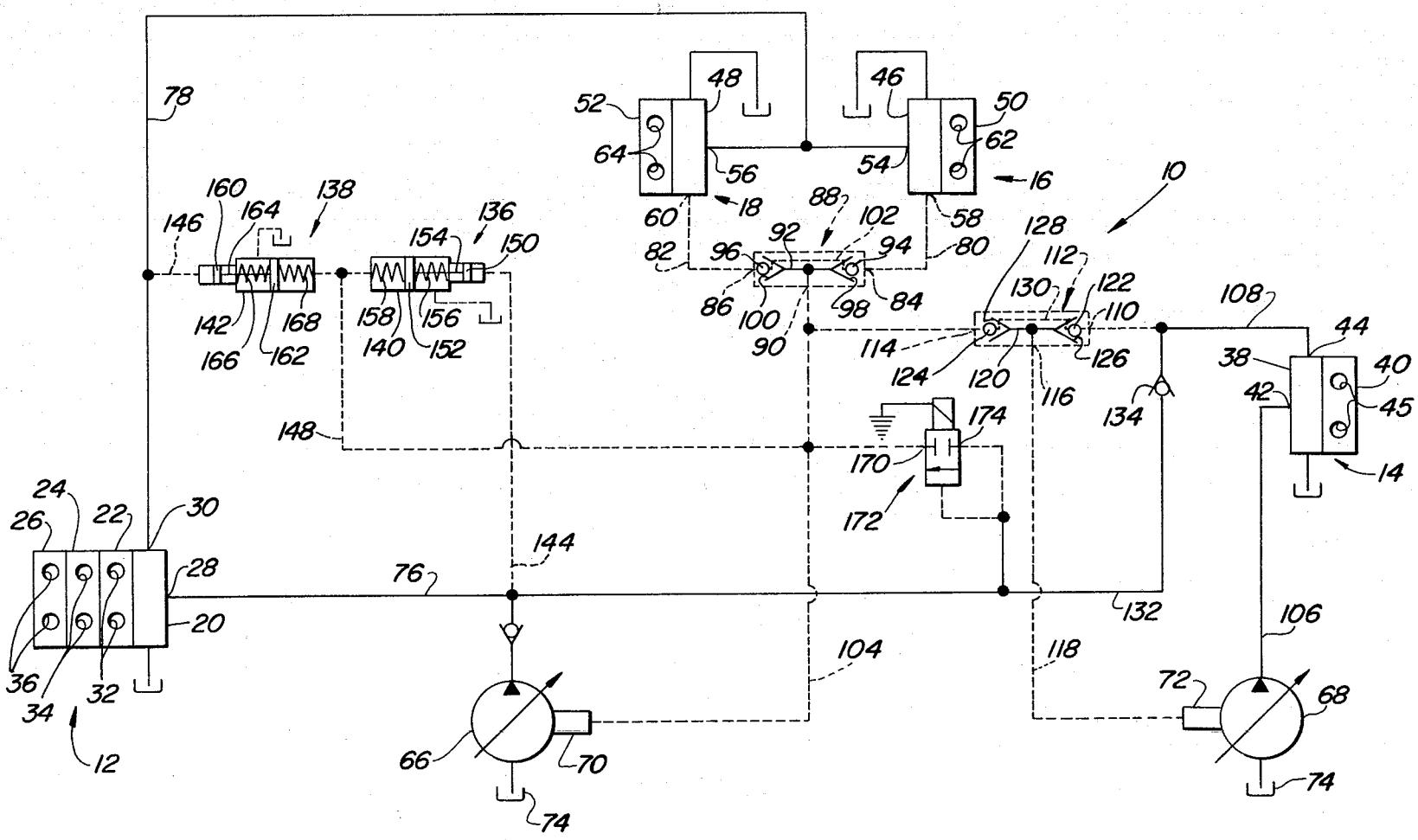
10
12
14
16
18
20
22
24
26
28
30
32
34
36
38
40
42
44
45
46
48
50
52
54
56
58
60
62
64
66
68
70
72
74
76
78
80
82
84
86
88
90
92
94
96
98
100
102
104
106
108
110
112
114
116
118
120
122
124
126
128
130
132
134
136
138
140
142
144
146
148
150
152
154
156
158
160
162
164
166
168
170
172
174

HYDRAULIC SYSTEM HAVING VARIABLE DISPLACEMENT PUMPS CONTROLLED BY POWER BEYOND FLOW

BACKGROUND OF THE INVENTION

The present invention relates to a hydraulic system and more particularly relates to hydraulic systems including one or more variable displacement pumps having their displacements controlled automatically in response to the requirement of various hydraulic functions as indicated by power beyond flow emanating from control valves for the various functions.

Power beyond is a typical option available on most valves used in open center or constant flow hydraulic systems. With a plurality of control valves connected in series, this option gives the first control valve priority on the hydraulic flow available and when the flow is not used it is directed out the power beyond port to the next valve rather than back to the hydraulic reservoir as is done with conventional open center valves.

The most common open center power beyond valves use open center spools for function control. The spools are moved to restrict the flow through the open center passage causing a pressure increase to the load pressure. The flow is divided between the open center passage and the work ports with the open center flow being directed out the power beyond port and the returning load flow being directed back to sump. Dividing flow in this manner makes it difficult for an operator to control the speed of a function since fluctuations in function load must be compensated for by spool movement.

This problem of control is somewhat alleviated by a more specialized type of open center, power beyond valve which incorporates a pressure compensated flow control valve which operates to divide flow in response to the demand for fluid of a function controlled by the valve. Flow is related to spool movement with the flow being maintained constant for varying function loads and also being limited to a predetermined rate. Examples of pressure compensated, open center, power beyond valves are found in U.S. Pat. No. 3,455,210 issued to Allen on July 15, 1969; U.S. Pat. No. 3,465,519 issued to McAlvay et al on Sept. 9, 1969; and U.S. Pat. No. 3,718,159 issued to Tennis on Feb. 27, 1973.

For the sake of efficiency, systems employing open center valves use variable displacement pumps which are automatically controlled in some way to meet the instantaneous demand of the systems. One example of a system employing a variable displacement pump controlled in this manner is disclosed in the aforementioned McAlvay et al patent. Specifically, McAlvay et al disclose a system employing a single variable displacement pump, a multiplicity of functions and control valves therefore with the power beyond flow from the last control valve being coupled to a pressure responsive displacement controller for decreasing the output of the pump in response to increasing power beyond flow.

The McAlvay et al system suffers from the disadvantage that it does not make provision for having functions of equal priority connected in parallel to a common source of fluid pressure or for situations where a second pump is needed for supplying the maximum possible demand that the functions might have for fluid.

SUMMARY OF THE INVENTON

According to the present invention there is provided a novel hydraulic system incorporating control valves of the pressure compensated, power beyond type and a pair of variable displacement controllers associated therewith and controlled by certain power beyond pressures.

It is an object to provide a hydraulic system wherein a displacement controller for a variable displacement pump is subject to the lesser of power beyond pressure emanating from the power beyond ports of a pair of control valves for selectively controlling a pair of parallel-connected functions.

Another object of the invention is to provide a hydraulic system including first and second variable displacement pumps each having their displacements controlled in accordance with the lesser of the power beyond pressure emanating from respective control valves receiving fluid from the pumps, the hydraulic system further including a fluid transfer conduit for permitting flow from the power beyond port of the first pump to be added to the flow from the second pump when the pressure of the power beyond flow of the control valve(s) supplied by the first pump is greater than the pressure of the power beyond flow of the control valve(s) supplied by the second pump.

These and other objects of the invention will become apparent from a reading of the ensuing description together with the appended drawings.

BRIEF DESCRIPTION OF THE DRAWINGS

The sole FIGURE is a schematic representation of a hydraulic control system for an excavator.

DESCRIPTION OF THE PREFERRED EMBODIMENT

Referring now to the drawing, therein is shown an excavator hydraulic control system indicated in its entirety by the reference numeral 10. The hydraulic control system 10 incorporates various control valves of the pressure compensated, power beyond type and preferably these valves are of a construction similar to that of the valve disclosed in the aforementioned U.S. Pat. No. 3,718,159 except that some of the control valves include only one function control section stacked together with an inlet section as compared to the patented structure which discloses three function control sections stacked together with an inlet section.

Specifically, the control system 10 includes a hoe control valve 12, a house swing control valve 14 and right and left travel control valves 16 and 18, respectively, which are all shown here in block form for simplicity.

The hoe control valve 12 comprises an inlet section 20 stacked together with boom, arm and bucket control sections 22, 24 and 26, respectively. The inlet section 20 includes an inlet port 28 and a power beyond port 30 and embodies a pressure compensated flow control valve (not shown) which divides the flow entering the inlet between the power beyond port and a passage leading to the function control sections in accordance with the location of respective control valve spools located in the sections and the demand of a function being controlled. The boom, arm and bucket control sections have pairs of service passages 32, 34 and 36, respectively with each of the pairs being adapted for connection to opposite ends of double-acting hydraulic cylinders.

The house swing control valve 14 includes an inlet section 38 stacked together with a swing control section 40. The inlet section 38 is similar to the inlet section 20 of the valve 12 described above and includes an inlet port 42 and a power beyond port 44. The swing control section 40 includes a pair of service ports 45 adapted for connection to opposite ports of a reversible swing motor.

The right and left travel control valves 16 and 18 are identical and include respective inlet sections 46 and 48 and respective travel control sections 50 and 52. The inlet sections 46 and 48 include inlet ports 54 and 56, respectively, and power beyond ports 58 and 60, respectively. The travel control sections 50 and 52 include pairs of service ports 62 and 64, respectively, adapted for connection to opposite ports of reversible right and left traction drive motors.

Provided for supplying fluid to the control valves are first and second variable displacement hydraulic pumps 66 and 68, respectively, having pressure responsive displacement controllers 70 and 72 associated therewith and operative to increase the displacements of the pumps 66 and 68 in response to receipt of respective decreased pressure signals.

The pump 66 has an inlet connected to a sump 74 and an outlet connected to the inlet port 28 of the inlet section 20 of the hoe control valve 12 by a fluid supply conduit 76. A first power beyond fluid conduit 78 has a first end connected to the power beyond port 30 of the inlet section 20 and a branched second end connected to the inlet ports 54 and 56 of the travel control valves 16 and 18. Second and third power beyond fluid conduits 80 and 82, respectively, connect the power beyond ports 58 and 60 of the control valves 16 and 18 to first and second inlet ports 84 and 86, respectively of a shuttle valve 88. The shuttle valve 88 includes an outlet port 90 connected to the inlet ports 84 and 86 by a central passage 92. First and second check balls 94 and 96 are located in the passage 92 on opposite sides of the connection of the latter with the outlet port 90 and are respectively located for engagement with first and second valve seats 98 and 100, respectively, for preventing flow from the inlet ports 84 and 86 to the outlet port 90. A pin represented schematically at 102 is reciprocably mounted in the passage 92 between the check balls 94 and 96 and is of a length greater than the distance between the valve seats 98 and 100 so that only one of the check balls may be seated at one time (see FIG. 3 of U.S. Pat. No. 3,863,449 granted Feb. 4, 1975 for a shuttle valve of this type). Thus, it will be appreciated that the greater of the pressures in the power beyond conduits 80 and 82 will act on the shuttle valve 88 to seat one of the check balls 94 and 96 and unseat the other so that the lesser of the pressures in the conduits 80 and 82 is communicated to the outlet port 90.

The outlet port 90 of the shuttle valve 88 is connected, as by a pilot fluid conduit 104, to the displacement controller 70 of the pump 66.

The pump 68 has an inlet connected to the sump 74 and an outlet connected to the inlet port 42 of the swing control valve 14 by a fluid supply conduit 106. A fourth power beyond fluid conduit 108 connects the power beyond port 44 to a first inlet port 110 of a shuttle valve 112 having a construction identical to the aforedescribed shuttle valve 88. The valve 112 includes a second inlet port 114 connected to the pilot fluid conduit 104 and an outlet port 116 connected to the displacement controller 72 of the pump 68 by a pilot fluid conduit 118. A central passage 120 interconnects the ports 110, 114 and 116 and provided for controlling the flow of fluid from the inlet ports 110 and 114 to the outlet port 116 are first and second check balls 122 and 124, respectively, positioned for seating against first and second valve seats 126 and 128. A pin shown diagrammatically at 130 is reciprocably mounted in the passage 120 between the check balls 122 and 124 and is of a length sufficient to prevent simultaneous seating of the check balls. Thus, it will be appreciated then that the shuttle valve 112 will act to connect the lesser of the two fluid pressures respectively existing in the pilot fluid conduit 104 and the fourth power beyond fluid conduit 108 to the pilot fluid conduit 118 and, hence, to the displacement controller 72 of the pump 68.

A bypass circuit including a bypass conduit 132 is connected between the fourth power beyond fluid conduit 108 and the fluid supply conduit 76. Located in the bypass conduit 132 is a one-way valve 134 which permits flow only in the direction from the conduit 108 to the conduit 76. Accordingly, when the pressure in the conduit 108 is greater than that in the pilot fluid conduit 104, the shuttle valve 112 will act to prevent flow from the conduit 108 to the pilot fluid conduit 118 and the pressure in the conduit 108 will open the valve 134 to thereby connect the power beyond conduit 108 to the fluid supply conduit 76 thus resulting in the flow from the pump 68 supplementing that from the pump 66.

In order that the displacement of the pump 66 may more quickly be adjusted to accommodate changes in the demands of the hoe functions served by the valve 12, a pair of lead compensators 136 and 138 are connected in the circuitry leading to and from the hoe control valve 12. Specifically, the lead compensators 136 and 138 respectively comprise stepped cylindrical chambers 140 and 142. The chamber 140 has a small end connected to the fluid supply conduit 76 by a conduit 144 while the chamber 142 has a small end connected, as at 146, to the first power beyond fluid conduit 78. The chambers 140 and 142 have respective large ends connected to each other and to the pilot fluid conduit 104 by a branched conduit 148. Respectively reciprocably mounted in the small and large sections of the chamber 140 are small and large pistons 150 and 152, which are interconnected by a rod 154. A pair of centering springs 156 and 158 are located on opposite sides of the large piston 152 and bias it toward a centered position in the large section of the chamber 140. Similarly, the chamber 142 has small and large pistons 160 and 162, respectively, reciprocably mounted therein and interconnected by a rod 164. A pair of centering springs 166 and 168 are located on opposite sides of the large piston 162.

It will thus be appreciated that when there is a sudden high demand for flow for operation of the hoe function controlled by the hoe control valve 12, the power beyond flow in the power beyond fluid conduit 78 will diminish so as to reduce the pressure acting against the small piston 160 of lead compensator 138. The piston 160 will then be shifted leftwardly by unbalanced forces resulting in an increased volume in the end of large section of the chamber 142 which in turn results in a decrease in the pressure in the branched conduit 148 and, hence, a decrease of pressure in the pilot fluid line 104. The displacement controller 70 of the pump 66 will respond to this decrease in pressure and increase the displacement of the pump 66. The increased flow from the pump 66 will initially effect increased pressure against the small piston 150 of the lead compensator 136 so as to create a force imbalance causing the piston to shift leftwardly to cause the large piston 152 to force fluid from the large end of the chamber 140. By this time, the initial drop in fluid pressure in the power beyond fluid conduit 78 will probably have found its way through the circuit so as to appear in the pilot pressure fluid line 104 so any increase in the pressure in the line 104 occasioned by the leftward shift of the piston 152 will be overshadowed by the decrease in pressure and the displacement of the pump 66 will be increased in accordance with any net decrease in pressure in the line 104.

Also connected to the branched conduit 148 is an outlet port 170 of a solenoid operated power limiting valve 172 having an inlet port 174 connected to the fluid supply conduit 76 by a section of the bypass conduit 132 downstream of the one-way valve 134. The power limiting valve 172 is shown in a normally deenergized position wherein it blocks fluid communication between the conduit 132 and the pilot fluid conduit 104. Actuation of the power limiting valve 172 is preferrably made in response to the output speed of the excavator engine falling to a preselected minimum. Any well known speed sensing circuit may be utilized for sensing the output speed of the engine and energizing the solenoid of the valve 172 at the preselected minimum speed. When the valve 172 is energized, it will shift to connect the conduit 132 and hence the output of the pump 66 and any flow passing through the one-way valve 134 to the pilot fluid conduit 104 to thereby increase the pressure in the controller 70 to decrease the displacement of the pump 66 which will in turn relieve some of the load on the engine so as to prevent the latter from stalling.

The operation of the hydraulic control system 10 is briefly stated as follows. During operation of the excavator, the control valves 12, 14, 16 and 18 will operate to divide available flow between any actuated function and the power beyond port of the valve. For example, the portion of the flow arriving at the hoe function control valve 12 which is not needed for function operation will be passed on to the left and right travel function control valves 16 and 18 via the power beyond fluid conduit 78. That portion of the flow arriving at the travel function control valves 16 and 18 which is not used for operating the travel functions is respectively passed on to the power beyond fluid conduits 80 and 82. The shuttle valve 88 will then operate in response to the greater of the fluid pressures existing in the conduits 80 and 82 to connect the losses of the fluid pressures existing in the conduits 80 and 82 to the pilot fluid conduit 104 and, hence, to the displacement controller 70 of the pump 66. The controller 70 operates in response to the pressure in the fluid conduit 104 to establish a displacement calculated to result in only slightly more fluid being pumped by the pump 66 than is needed to operate the hoe and/or travel functions being actuated.

Meanwhile, that portion of the flow arriving at the swing function control valve 14 which is not needed for operating the swing function is passed on to the power beyond fluid conduit 108. The shuttle valve 112 operates in response to the pressure of the fluid in the pilot fluid conduit 104 and the pressure of the fluid in the power beyond fluid conduit 108 to connect the lesser of the two pressures to the pilot fluid conduit 118 and, hence, to the displacement controller 72 of the pump 68. If the pressure in the conduit 108 is greater than the pressure in the conduit 118, the one-way valve 134 will open to join the flow from the power beyond fluid conduit 108 with the flow from the pump 66. In this way, the pump 68 may at some time operate to aid the pump 66 in supplying an unusual demand from the hoe and travel functions. This permits the pump 66 to have a smaller displacement than would otherwise be the case.

It is here noted, that for some applications the displacement of the pump 66 may be adequate under all conditions to supply the needs of the hoe and travel functions and in such an application the bypass circuit and the shuttle valve 112 could be eliminated with the power beyond fluid conduit 108 being connected directly to the displacement controller 72.

The operation of the lead compensators 136 and 138 and the power limiting valve 172 are thought to be evident from the description thereof set forth above and for the sake of brevity are not repeated here.

We claim:

1. In a hydraulic system including a variable displacement pump, a pressure responsive displacement controller connected to the pump for decreasing the displacement thereof in response to receiving increasing signal pressure, a primary function control valve having a supply inlet connected to the pump, service ports adapted for connection to a primary function and a primary function power beyond port, first and second secondary function control valves having respective supply inlets coupled to the primary function power beyond port, respective service ports adapted for connection to first and second secondary functions, and first and second secondary function power beyond ports, the primary and first and second secondary function control valves each including a demand responsive flow divider for dividing flow between the respective power beyond and service port of each valve, when the latter are actuated, respectively, in accordance with the fluid required by the primary and first and second secondary functions, the improvement comprising: shuttle valve means coupled to the first and second secondary function power beyond ports and to the pump displacement controller and being operable for routing the lesser of the fluid pressure existing at the first and second secondary function power beyond ports to the pump displacement controller to thereby automatically control the pump to satisfy the highest demand of the first and second secondary functions.

2. The hydraulic system defined in claim 1 wherein the shuttle valve means comprises a valve body defining a bore; first and second inlet ports spaced from each other along the bore and respectively coupled to the first and second secondary function power beyond ports; and outlet port communicating with the bore at a location between the first and second inlet ports and being connected to the pump displacement controller; a first valve seat located in the bore between the first inlet port and the outlet port and facing the first inlet port; a second valve seat located in the bore between the second inlet port and the outlet port and facing the second inlet port; first and second check balls respectively located in the bore for engagement with the first and second valve seats; and a pin located in the bore between the check balls and having a length greater than the distance between the first and second valve seats whereby only one of the first and second check balls may be seated at any one time.

3. A hydraulic system for a machine having multiple hydraulic functions, comprising: first and second variable displacement pumps; first and second pressure responsive displacement controllers connected to the first and second pumps, respectively; a first primary function control valve having a supply inlet port coupled to the first pump service ports adapted for connection to a first primary function and a first primary function power beyond port; a second primary function control valve having a supply inlet coupled to the second pump, service ports adapted for connection to a second primary function, and a second primary function power beyond port; a secondary function control valve means having supply inlet port means coupled to the first primary function power beyond port, service port means adapted for connection to secondary function means, and secondary function power beyond port means; said first and second primary function control valves each including a demand responsive flow divider for dividing flow between the respective power beyond and service ports of each valve, when the latter are actuated, respectively in accordance with the fluid required by the first and second primary functions; said secondary function control valve means including a demand responsive flow divider means for dividing flow between the power beyond port means and service port means, when the secondary function control valve means is actuated, in accordance with the fluid required by the secondary function means; a shuttle valve means having a first inlet port coupled to the first pressure responsive displacement controller and to the secondary function power beyond port means, a second inlet port coupled to the secondary primary function power beyond port and an outlet port coupled to the second pressure responsive displacement controller and being operative for routing the lesser of the fluid pressure existing at its first and second inlet ports to its outlet port.

4. The hydraulic system defined in claim 3 and further including a bypass circuit including a conduit connecting the second inlet port of the shuttle valve means to the supply inlet port of the first primary function; and a one-way valve located in the last-named conduit for preventing flow in the direction of the second shuttle valve means, whereby when the pressure of the fluid in the second primary function power beyond port is greater than the pressure of the fluid in the first and second secondary power beyond ports, the flow in the second primary function power beyond port will be joined with the flow provided by the first variable displacement pump.

5. A hydraulic system for a machine having multiple hydraulic functions, comprising: first and second variable displacement pumps; first and second pressure responsive displacement controllers connected to the first and second pumps, respectively; a first primary function control valve having a supply inlet port coupled to the first pump, service ports adapted for connection to a first primary function, and a first primary function power beyond port; a second primary function control valve having a supply inlet coupled to the second pump, service ports adapted for connection to a second primary function, and a second primary function power beyond port; first and second secondary function control valves having respective supply inlet ports coupled to the first primary function power beyond port, respective service ports adapted for connection to first and second secondary functions, and first and second secondary function power beyond ports; said first and second primary, and first and second secondary function control valves each including a demand responsive flow divider for dividing flow between the respective power beyond and service ports of each valve, when the latter are actuated, respectively in accordance with the fluid required by the first and second primary, and the first and second secondary functions; a first shuttle valve means having first and second inlet ports coupled to the first and second secondary function power beyond ports and an outlet coupled to the first pressure responsive displacement controller and being operative for routing the lesser of the fluid pressure existing at its first and second inlet ports to its outlet port; a second shuttle valve means having first and second inlet ports respectively coupled to the second primary function power beyond port and to the outlet of the first shuttle valve means, and an outlet port coupled to the second pressure responsive displacement controller and being operable for routing the lesser of the two pressures existing at its first and second inlet ports to its outlet; a bypass circuit including a conduit connecting the second inlet port of the second shuttle valve means to the supply inlet port of the first primary function; and a one-way valve located in the last-named conduit for preventing flow in the direction of the second shuttle valve means, whereby when the pressure of the fluid in the second primary function power beyond port is greater than that of either of the pressures of the fluid in the first and second secondary power beyond ports, the flow in the second primary function power beyond port will be joined with the flow provided by the second variable displacement pump.

* * * * *

UNITED STATES PATENT AND TRADEMARK OFFICE

CERTIFICATE OF CORRECTION

PATENT NO. : 4,335,577

DATED : 22 June 1982

INVENTOR(S) : Raymond J. Lobmeyer and James A. Miller

It is certified that error appears in the above-identified patent and that said Letters Patent is hereby corrected as shown below:

Column 7, line 28, delete "secondary" and insert -- second --.

Signed and Sealed this

*Thirtieth* Day of *November 1982*

[SEAL]

*Attest:*

GERALD J. MOSSINGHOFF

*Attesting Officer*

*Commissioner of Patents and Trademarks*